United States Patent [19]

Ford, Jr.

[11] 3,991,902

[45] Nov. 16, 1976

[54] LATCH FOR PAN COVERS

[76] Inventor: Edward B. Ford, Jr., 6405 Bardu Ave., Springfield, Va. 22152

[22] Filed: May 29, 1975

[21] Appl. No.: 581,858

[52] U.S. Cl. ..... 220/324; 292/106

[51] Int. Cl.[2] ..... B65D 45/16

[58] Field of Search ..... 220/324, 323; 292/101, 292/103, 95, 300, 102, 104, 105, 106, 107

[56] References Cited

UNITED STATES PATENTS

| | | | |
|---|---|---|---|
| 486,539 | 11/1892 | Reese | 292/105 |
| 637,643 | 11/1899 | Morrison | 292/107 |
| 882,145 | 3/1908 | Eiber | 292/106 |
| 1,129,115 | 2/1915 | Nye | 220/324 |
| 3,576,340 | 4/1971 | Jones et al. | 220/324 |

*Primary Examiner*—George E. Lowrance
*Assistant Examiner*—Joseph M. Moy
*Attorney, Agent, or Firm*—Laurence R. Brown

[57] ABSTRACT

A simple manually operable sanitary latch is provided to retain a cover on a pan while heating or for lifting the pan by the lid, as particularly useful in an environment such as a restaurant or hospital. The latch comprises two members, one being a U-shaped hook affixed to the cover at the edge, so that it goes under the upper lip of a mating pan. On an opposite edge of the cover is a movable latch member retained by a strap like bracket affixed substantially parallel to the cover, which permits the latch to move normally to the edge of the lid. This movable latch has an outermost hook for registering under the lip of the mating pan and an innermost abuttment member that restricts the extent of movement away from a latched position where the cover can be removed.

5 Claims, 6 Drawing Figures

LATCH FOR PAN COVERS

This invention relates to covers for pans or trays and more specifically it relates to latching covers that hold a cover in place on a pan during heating and transport.

GENERAL STATE OF THE PRIOR ART

If a pan or tray is to be used in a sanitary environment it must be easily sanitized. Thus, any latching means that has complicated parts not fully accessible for sterilization is not suitable. Prior art latches are so complex that they include detents, springs, pivots or levers that can provide pockets where bacteria or other unwanted materials may become lodged. Also, such latches involving mechanisms need to be lubricated an otherwise are subject to wear and possible defects in manufacture because of the necessity for several parts working together. No known prior art latch has overcome these defects.

Trays used in hospitals, etc. for sterilization may need a cover retainer while water is being boiled to keep out foreign objects and to partly confine the steam. Likewise, cooking pans in restaurants, such as found in steam tables need be covered at times and while cooking contents the cover should be retained by a latch. Also it is important that a latch assembly be suitable for permitting transport of a filled pan by means of the cover, and while it is covered, particularly when it is to be lifted out of a steam table. Thus, a sterile type latch assembly is necessary, and has not heretofore been produced in such form that it does not have pockets or regions that tend to accumulate undesired food or bacteria.

A further problem in this art is that an inexpensive latch assembly, simple to manufacture, must be provided that does not significantly increase the cost. This requirement in general is onconsistent with known latch mechanisms, which either of themselves are too costly or which require too costly tooling or manufacturing techniques. Some mechanisms, require different size latches for different size pans. This too is an undesirable feature.

OBJECTS OF THE INVENTION

Accordingly, it is a general object of this invention to produce improved manual latches for tray or pan covers, which solve one or more of the foregoing problems.

A more specific object of the invention is to provide a simple, inexpensive, sanitary, manually-operable latch for pan covers.

BRIEF DESCRIPTION OF THE INVENTION

Therefore in accordance with this invention, two latch elements are affixed respectively at opposite sides of a pan cover. One element is simply a U-shaped hook member affixed to one edge of the cover at the top surface and extending below and inwardly directed so that it will hook under a rim of a mating pan on which the cover rests. The other element is retained on an opposite edge of the cover on top of it by a simple strap bracket and constitutes a movable strip with a hook at one end and a butt member on the opposite end to limit the degree of latch movement. Other objects, features and advantages will be found throughout the following description.

DETAILED DESCRIPTION OF THE INVENTION

Figure 1:
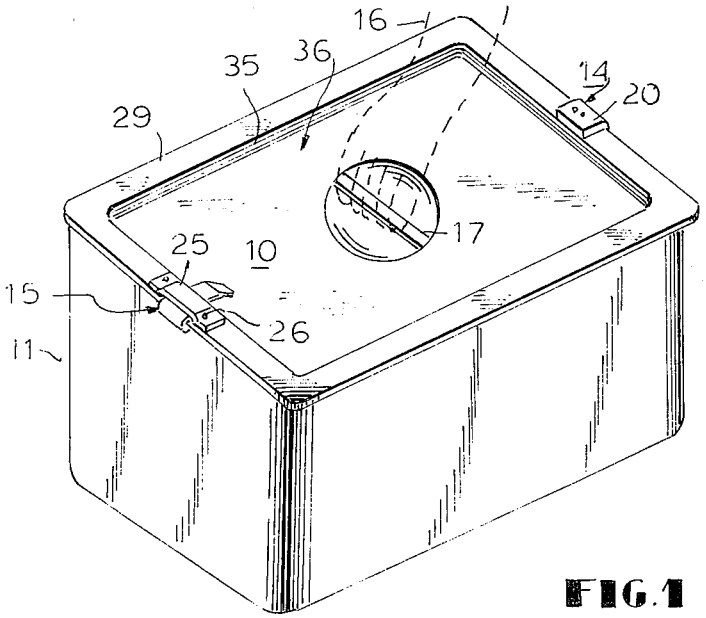
FIG. 1 is a perspective view looking down upon a latching cover in place on a pan.

As may be seen in the drawing, a lid 10 is placed on pan 11, and is retained there by two latch members 14, 15 so that the entire pan assembly may be lifted and transported manually (16) by means of handle 17. Latch member 14 is simply a generally U-shaped hook part affixed to the top surface of lid 10 at one end of the hook by means of spot welds 20 for example, so that the opposite end 21 extends downwardly and inwardly toward the pan 11 to engage an outwardly oriented upper lip 22 thereon at the open upper edge of the pan. The lid, latch parts and pan are preferably of stainless steel which is easy to sanitize, and can be used with food or in other sanitary environments.

The latch member 15 has a longitudinal retaining strap 25, welded to the upper lid surface at 26, etc. substantially parallel to the edge of the lid (which can be in other shapes such as circular for example). The retaining strap 25 is mounted on the outer rim 29 of the lid 10 to hold movable latch part 30 for substantially normal movement from the edge of the lid. Thus the generally U-shaped end hook portion of latch part 30 terminating in the lower end 32 may be moved in and out over a limited degree of movement stopped by stop member 33, in this embodiment simply a bend downward at the end of the latch member 30 strap which strikes as an abutment the tapered ridge portion of the lid 10 joining ridge 29 with the central recessed plane 36.

Figure 2:
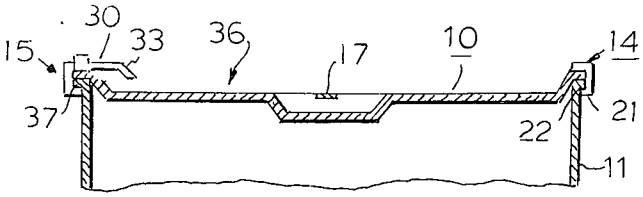
FIG. 2 is a partial section view through the pan and lid showing the opposed latching members in elevation view.
Figure 6:
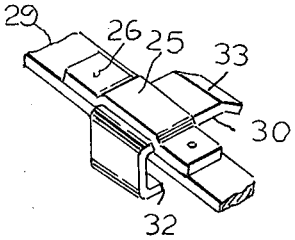
Figure 4:
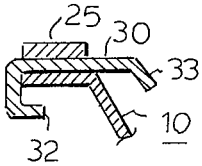

Accordingly, as better seen from FIGS. 2, 4 and 6, the latch part 15 may be manually closed by sliding movable strap member 30 so that the hooked end 32 is registered under the lip 37 of the pan 11. Depending upon usage of the pan this may be a loose fit or a ramp type friction fit to retain the lid alternatively loosely or firmly in place.

Figure 5:
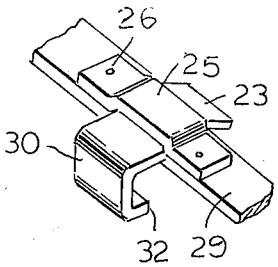
FIGS. 5 and 6 are enlarged partial perspective views showing the movable latch member affixed to a rim of the cover in respective open and closed positions.
Figure 3:
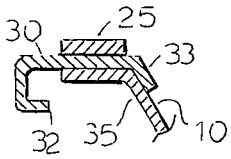
FIGS. 3 and 4 are partial enlarged section views of the movable latch member in open and closed position respectively.

To unlatch the lid 10, the latch strap 30 is simply moved to the left as shown in the drawings to attain the position shown in FIGS. 3 and 5, where the movement is stopped by engagement of stop member 33 abutting the tapered section 35 of the lid. It is seen that the movable part 30 may be grasped between two fingers for this movement which is unimpeded except for slight frictional inertia between the movable portion 30, the retainer strap 25 and the rim 29 of the lid. For use on a planar lid, the end 33 may be upturned to stop upon engagement with the strap 25.

As may be visualized from the drawings, there are no pivots, springs, inaccessible or covered parts of any kind that are not available for cleansing or sanitation. Also, the entire assembly is made from three simple metal straps bent into simple shapes and welded at four positions to the cover, so that the manufacture is simple and the cost low.

Having therefore provided an improved manually operable latch assembly for sanitary vessels and described its structure and operation, those features of novelty believed descriptive of the nature and spirit of the invention are set forth with particularity in appended claims.

What is claimed is:

1. Sanitary means for adapting a lid to be latched to a mating pan comprising in combination, a lid having an outer rim around the edge thereof and a central indented portion connected by a tapered ledge to said rim, a mating pan having a rim around the edge thereof, two latch members affixed at opposite rims of said lid, the first member consisting of a generally U-shaped hook part affixed at one end to the upper side of said lid with the other end extending below said lid in a position to hook over the rim of said mating pan, and the second latch member consisting of a retainer part in the form of a longitudinal strap oriented generally parallel to the rim of said lid and affixed to the upper side thereof at each end to retain thereunder between the ends a latch part movable to the rim of said pan, said latch part consisting of a strap member formed with a generally U-shaped hook portion at one end thereof positioned to hook under the rim of said pan when positioned adjacent the rim of said lid and formed with a stop member at the other end to engage the lid assembly at a position permitting the movement of said latch part to place its hook far enough away from the rim of said lid to permit the hook portion to clear the rim of said pan wherein said stop member consists of a downward bend on said strap member of said latch part that conforms in shape with said tapered ledge.

2. Sanitary means as defined in claim 1 including a lid having a handle thereon for lifting a pan therewith when latched to said lid by said latch part.

3. Sanitary means as defined in claim 1, wherein said lid is stainless steel having solely the three latch member parts aforesaid, and each of the three latch member parts are formed of stainless steel straps and two are welded in place on said lid.

4. Sanitary means as defined in claim 1 with said pan having a wall defining an upper peripheral lip at its open upper edge extending substantially in a single plane so that said lip extends outwardly from said wall and is inserted between the two ends of both said two hooks at opposite sides of said lid together with a mating portion of the edge of said lid.

5. Sanitary means as defined in claim 1, wherein said lid is substantially rectangular in shape and is held in place solely by said two latch members located on two opposite sides of said rectangle.

* * * * *